US007222628B2

(12) United States Patent
King

(10) Patent No.: US 7,222,628 B2
(45) Date of Patent: May 29, 2007

(54) ARTIFICIAL NAIL APPARATUS

(76) Inventor: LaRue Ezelle King, 6917 W. Mary Jane Ln., Peoria, AZ (US) 85382

( * ) Notice: Subject to any disclaimer, the term of this patent is extended or adjusted under 35 U.S.C. 154(b) by 42 days.

(21) Appl. No.: 11/095,732

(22) Filed: Apr. 1, 2005

(65) Prior Publication Data

US 2005/0217684 A1 Oct. 6, 2005

Related U.S. Application Data

(60) Provisional application No. 60/559,492, filed on Apr. 3, 2004.

(51) Int. Cl.
*A45D 29/00* (2006.01)

(52) U.S. Cl. ..... 132/73

(58) Field of Classification Search ..... 132/73, 132/285; 2/21; 602/3, 31
See application file for complete search history.

(56) References Cited

U.S. PATENT DOCUMENTS

| | | | | |
|---|---|---|---|---|
| 931,511 | A * | 8/1909 | Southworth | 30/298 |
| 1,213,673 | A | 1/1917 | Marvel | |
| 2,323,854 | A * | 7/1943 | Silverman | 2/21 |
| 2,487,101 | A * | 11/1949 | Colby et al. | 2/21 |
| 2,546,619 | A * | 3/1951 | Turner | 2/21 |
| 2,799,282 | A * | 7/1957 | Slack | 132/285 |
| 4,107,947 | A | 8/1978 | Saito | |
| 4,445,234 | A | 5/1984 | Ogunro | |
| 4,559,055 | A | 12/1985 | Ogunro | |
| 4,665,934 | A * | 5/1987 | Jefferson | 132/320 |
| 4,899,557 | A * | 2/1990 | Schwartz | 63/15 |
| 4,984,592 | A | 1/1991 | Hellein | |
| 5,186,189 | A * | 2/1993 | Harris | 132/285 |
| 5,282,276 | A | 2/1994 | Preziose | |
| 5,413,123 | A | 5/1995 | Aylott et al. | |
| 5,675,989 | A * | 10/1997 | Abraskin | 63/41 |
| 5,803,094 | A * | 9/1998 | Becker et al. | 132/200 |
| D445,542 | S * | 7/2001 | Dubnicka et al. | D28/56 |
| 6,626,598 | B2 | 9/2003 | Schneider | |

FOREIGN PATENT DOCUMENTS

| | | | |
|---|---|---|---|
| FR | 1347157 A | * | 11/1963 |
| WO | WO99/30588 | * | 6/1999 |

* cited by examiner

*Primary Examiner*—Todd E. Manahan
(74) *Attorney, Agent, or Firm*—Parsons & Goltry; Michael W. Goltry; Robert A. Parsons

(57) ABSTRACT

An artificial nail apparatus includes an artificial nail with an upper surface, an opposing lower surface, and an end. The apparatus also includes a bridge having a first end fastened to the artificial nail at an engagement location and an opposing second end. A nail facing surface of the opposing lower surface is between the engagement location and the end. A digit receiving space is between the nail facing surface and the bridge and a digit engaging element is carried by the second end.

19 Claims, 4 Drawing Sheets

ARTIFICIAL NAIL APPARATUS

CROSS REFERENCES TO RELATED APPLICATIONS

This application claims the benefit of U.S. Provisional Application Ser. No. 60/559,492 filed on Apr. 3, 2004.

BACKGROUND OF THE INVENTION

1. Field of the Invention

This invention relates to artificial nails and, more particularly, to an artificial nail apparatus which appears as jewelry and an artificial nail when worn by a person.

2. Related Art and Prior Art Statement

It has been known in the art of adorning the hands to provide artificial fingernails in the shape of natural fingernails. Accordingly, numerous artificial fingernail manufacturers have provided a variety of combinations of materials, arrangements, and colors in fingernail accessories. With the advent of such artificial fingernail accessories, the person can now have intricately pre-designed fingernails. Prior art artificial fingernails are typically made of an opaque and hard plastic, although colored and flexible materials can also be used. These nails are generally attached to the natural nails with an adhesive and can be detached from the natural fingernails by later removing the adhesive. After the nails are applied, they are typically coated with a nail polish and/or a finishing material. The nail polish can be used to make the artificial nails look like the natural nails, although it can also be used to provide other attractive and unique nail appearances. The finishing material can be used to protect the nails and the nail polish from damage.

However, there are several problems with prior art artificial nails. One problem is that if the artificial nail brakes, then the natural nail can be damaged since they are adhered together. Another problem is that it is typically undesirable to replace the broken artificial nail until the natural nail heals, which can take an amount of time which depends on the extent of the damage. Accordingly, while prior art artificial nails may be suitable for their intended purposes, they leave much to be desired. As a result, there is a need for an improved artificial nail.

BRIEF SUMMARY OF THE INVENTION

The present invention provides an artificial nail apparatus with an artificial nail having an upper surface, an opposing lower surface, and an end. The apparatus also includes a bridge having a first end fastened to the artificial nail at an engagement location and an opposing second end. In some examples, a fastener can fasten the first end of the bridge to the artificial nail at the engagement location. A nail facing surface of the opposing lower surface is between the engagement location and the end. In some examples, the nail facing surface can carry a nail engaging adhesive or a nail engaging bandage.

In this embodiment, a digit receiving space is between the nail facing surface and the bridge. A digit engaging element is carried by the second end of the bridge. In one example, the digit engaging element and bridge are formed from an elongate strand. In some embodiments, the digit engaging element includes a ring with a digit receiving opening therethrough. In another embodiment, the digit engaging element includes a helical ring with a digit receiving opening therethrough.

The present invention also provides an artificial nail apparatus with an artificial nail including an upper surface, an opposing lower surface, a distal end, and a proximal end. The apparatus also includes a bridge having a first end and an opposing second end fastened to the artificial nail at an engagement location on the lower surface between the proximal and distal ends. In some embodiments, a fastener couples the bridge to the artificial nail at the engagement location. Further, in some embodiments, the bridge is made of a bendable material. In this embodiment, a digit engaging element is carried by the second end and has a digit receiving opening.

In some examples, the bridge and digit engaging element are formed from an elongate strand. In these examples, a bend can be in the elongate strand between the bridge and digit engaging element. A nail facing surface of the lower surface of the artificial nail is between the engagement location and the proximal end of the artificial nail. In some examples, the nail facing surface carries a double sided adhesive strip. In other examples, the nail facing surface carries a bandage. A digit receiving space is between the nail facing surface and the bridge. The digit receiving opening is coaxial with the digit receiving space.

The present invention further provides an artificial nail apparatus with an artificial nail having an upper viewing surface and a lower non-viewing surface, in which the upper viewing surface is opposed to the non-viewing surface. The apparatus also includes a bridge coupled to the non-viewing surface of the artificial nail at an intermediate location between proximal and distal ends of the nail. Further, the bridge can be made of a bendable material.

In this embodiment, a digit engaging element has a digit receiving opening and is spaced apart from the proximal end of the nail by the bridge. Further, a fastener couples the bridge to the non-viewing surface of the artificial nail. In some examples, the bridge and the artificial nail can be fastened together with complementary male and female components. The non-viewing surface of the artificial nail includes a nail facing surface between the intermediate location and the proximal end of the artificial nail. In some examples, an adhesive is carried by the nail facing surface of the artificial nail. In other examples, a bandage is carried by the nail facing surface of the artificial nail. In this embodiment, a digit receiving space is between the nail facing surface and the bridge. The digit receiving opening is coaxial with the digit receiving space. In some examples, the digit engaging element appears as a ring when engaging a digit and viewed from the upper viewing surface of the artificial nail.

These and other features, aspects, and advantages of the present invention will become better understood with reference to the following drawings, description, and claims.

BRIEF DESCRIPTION OF THE DRAWINGS

Referring to the drawings.

DETAILED DESCRIPTION OF THE INVENTION

Figure 1:
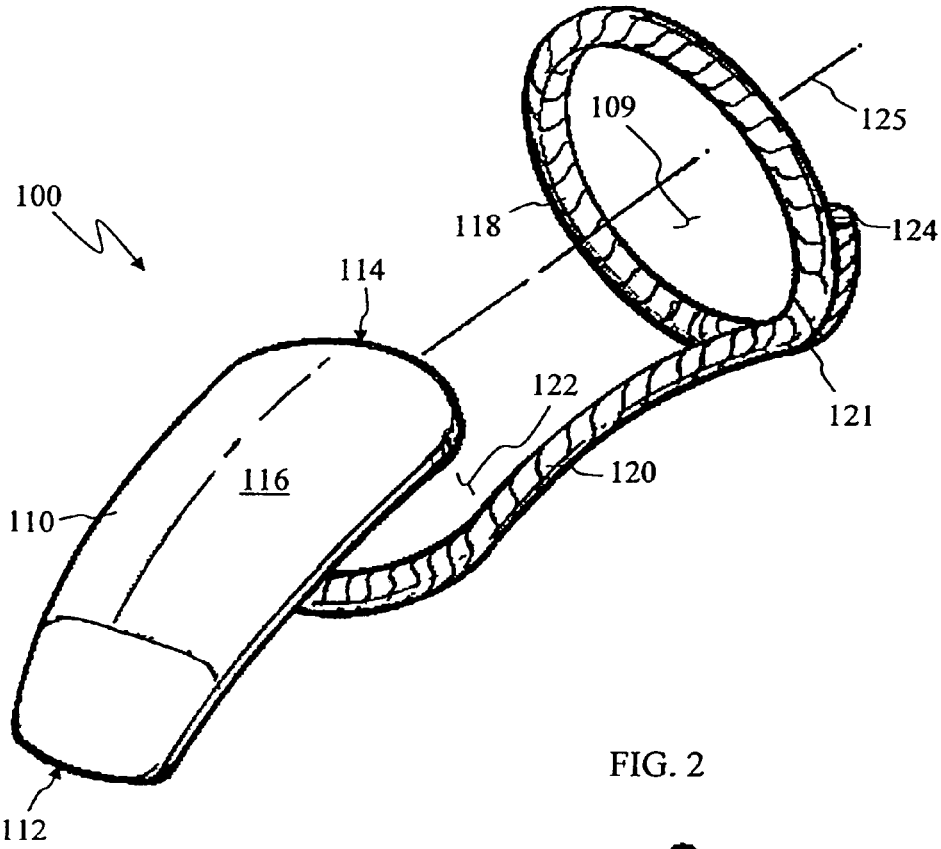
FIGS. 1, 2, and 3 are simplified perspective, top, and side views, respectively, of one embodiment of an artificial nail apparatus in accordance with the present invention designed to be worn on a finger.
Figure 2:
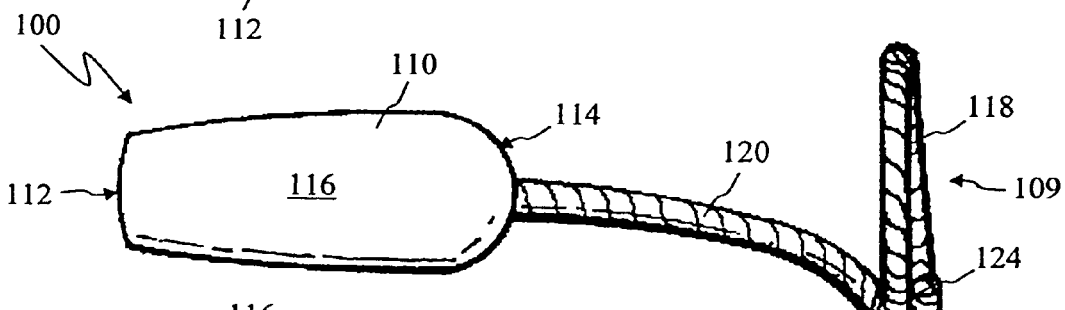
Figure 3:
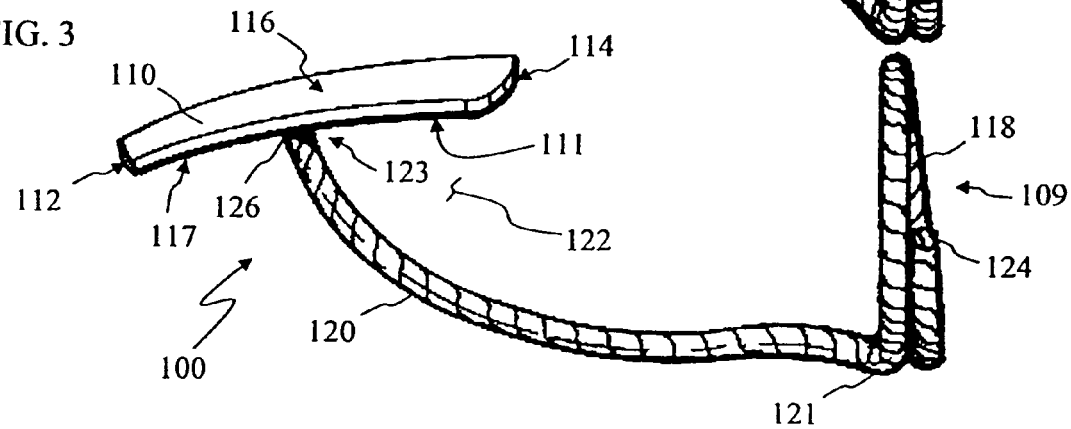

FIGS. 1, 2, and 3 are simplified perspective, top, and side views, respectively, of one embodiment of a artificial nail apparatus 100 in accordance with the present invention. It should be noted that like reference characters indicate corresponding elements throughout the several views. Artificial nail apparatus 100 is designed to be worn by a person on his or her digit, such as a finger or toe. In this particular example, however, apparatus 100 is formed and sized to be worn on a finger. Artificial nail apparatus 100 has several advantages. One advantage is that it can be easily worn by the person because it is conveniently attached and removed from the person's finger, as will be discussed in more detail below. Further, apparatus 100 can also be conveniently adjusted to accommodate the size and shape of a particular person's finger for a more comfortable fit. Another advantage is that the various components included in artificial nail apparatus 100 are interchangeable so the person can choose a desired esthetic look.

In this embodiment, artificial nail apparatus 100 includes an artificial nail 110 which extends between a distal end 112 and a proximal end 114. Apparatus 100 also includes a bridge 120 with an end 126 coupled to nail 110 at an engagement location 123 which is positioned intermediately between distal and proximal ends 112 and 114 (FIG. 3). Nail 110 has a viewing or upper surface 116 and opposing non-viewing or lower surfaces 111 and 117. Non-viewing surface 117 is between distal end 112 and engagement location 123 and non-viewing surface 111 is between proximal end 114 and engagement location 123. Surface 111 is sized and shaped so that it can fit over the person's natural nail or nail bed. In this example, the portion of nail 110 near distal end 112 on viewing surface 116 is sized and shaped so that it appears as a natural nail. It should be noted, however, that the portion of nail 110 near distal end 112 can be otherwise shaped so that it provides a desired esthetic look. For example, it can be squared, rounded, pointed, or have another desired shape.

In this embodiment, a finger-engaging element 118 is coupled to bridge 120 at a bend 121. Finger-engaging element 118 has a digit receiving opening 109 sized and shaped to receive the person's finger. Finger-engaging element 118 terminates at an end 124 which is positioned near finger-engaging element 118 so that finger-engaging element 118 forms a loop. Hence, bridge 120 and finger-engaging element 118 are a continuous elongate strand coupled together by bend 121. The elongate strand extends between ends 124 and 126 and is sized and shaped to receive the person's finger and hold nail 110 to the person's natural nail. The elongate strand can be made of a material that is rigid or it can be made of a material that can be easily bent and shaped by the person to fit his or her finger comfortably. Suitable materials include metal or plastic, for example.

Figure 7:
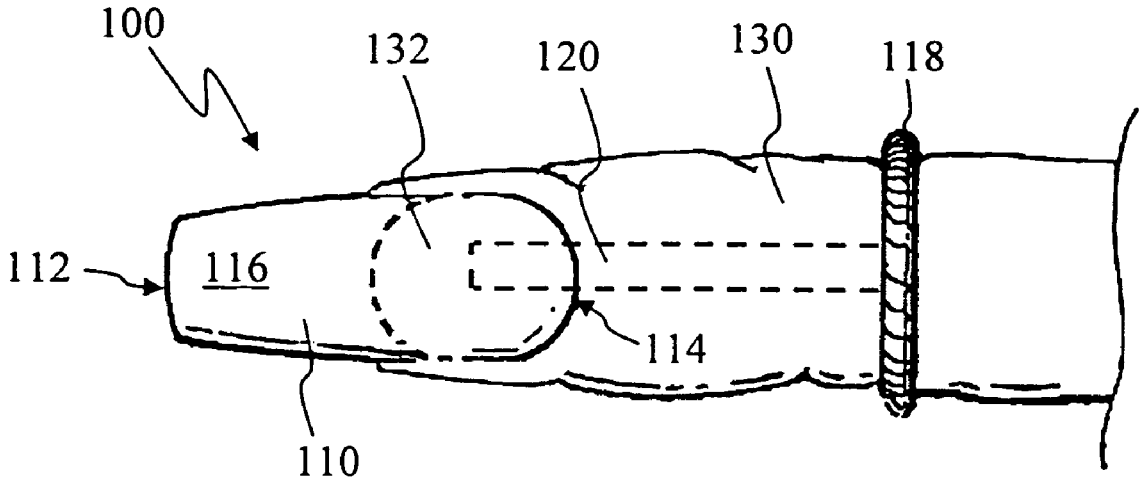
FIG. 7 is a simplified top view of the artificial nail apparatus of FIGS. 1–3 engaging a finger, in accordance with the present invention.

In accordance with the invention, proximal end 114 of nail 110 is separated from bridge 120 by a finger receiving space 122. Further, finger receiving opening 109 is coaxial with finger receiving space 122 along a reference line 125 (FIG. 1). The shape of bridge 120 is chosen to conform to the pad of the person's finger and the shape of surface 111 near proximal end 114 is chosen to conform to the shape of the person's natural finger nail or nail bed so that finger receiving space 122 conforms to the shape of the person's finger. As discussed in more detail below and as shown in FIG. 7, bridge 120 is positioned so that it is not seen from a top view. Hence, artificial nail apparatus 100 appears as an artificial nail and a ring from this view.

It should be noted, however, that bridge 120 and finger-engaging element 118 can have many other different configurations so that artificial nail apparatus 100 appears as an artificial nail and a ring when seen from the top view. For example, in some embodiments, bridge 120 and finger-engaging element 118 can be separate pieces coupled together so that they are not one continuous elongate strand, as discussed above. The separate bridge and ring pieces can be attached together in many different ways. In one embodiment, bend 121 can be replaced with complementary male and female components carried by finger-engaging element 118 and bridge 120 so that finger-engaging element 118 and bridge 120 can be fastened together. In another embodiment, bend 121 can be replaced with an adhesive, a welding joint, or a soldering joint to fasten finger-engaging element 118 and bridge 120 together. Further, it should be noted that artificial nail apparatus 100 can include various ornamental and/or decorative features to make it more esthetically pleasing, as will be discussed in more detail presently.

Figure 4:
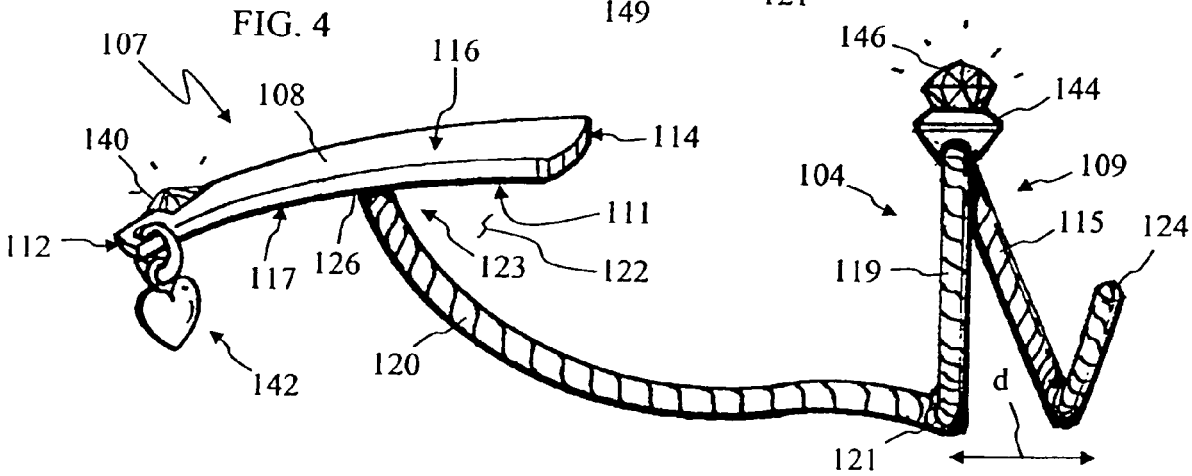
FIG. 4 is a simplified perspective view of an embodiment of the artificial nail apparatus of FIGS. 1–3 with ornamental and decorative features.

FIG. 4 is a simplified perspective view of an embodiment of an artificial nail apparatus 107 with both ornamental and decorative features. It should be noted that apparatus 107 is similar to apparatus 101 as discussed above. In this embodiment, artificial nail apparatus 107 includes an artificial nail 108 connected to bridge 120. Here, however, a decorative jewel 140 and an ornament 142 are positioned near distal end 112 of nail 108. Jewel 140 is positioned on viewing surface 116 of nail 108 and ornament 142 is coupled to nail 108 so that it extends between surfaces 116 and 117 and hangs therefrom nail 108. It should be noted that jewel 140 and ornament 142 can be otherwise positioned on nail 108 in other embodiments and the positioning of them here is for illustrative purposes.

Further, in this embodiment, a finger-engaging element 104 is coupled to bridge 120 through bend 121. Finger-engaging element 104 includes a jewel holder 144 which holds a decorative jewel 146 thereon. Jewel holder 144 and jewel 146 are positioned on finger-engaging element 104 so that the combination looks like an ordinary ring when artificial nail apparatus 107 is being worn by the person, as will be discussed in more detail below. In this example, finger-engaging element 104 includes a front ring portion 119 and a back ring portion 115 that extends away from bridge 120 so that proximal end 124 is spaced apart from bend 121 by a distance d. In this way, finger-engaging element 104 is helical in shape so that it better holds to the person's finger when apparatus 107 is being worn. It should also be noted that in other embodiments, only one of the ornamental or decorative features shown in FIG. 4, or combinations thereof, can be included. Further, these ornamental and decorative features are shown in FIG. 4 for illustrative purposes and other structures which make apparatus 107 more esthetically pleasing cab be used in other embodiments.

Figure 5:
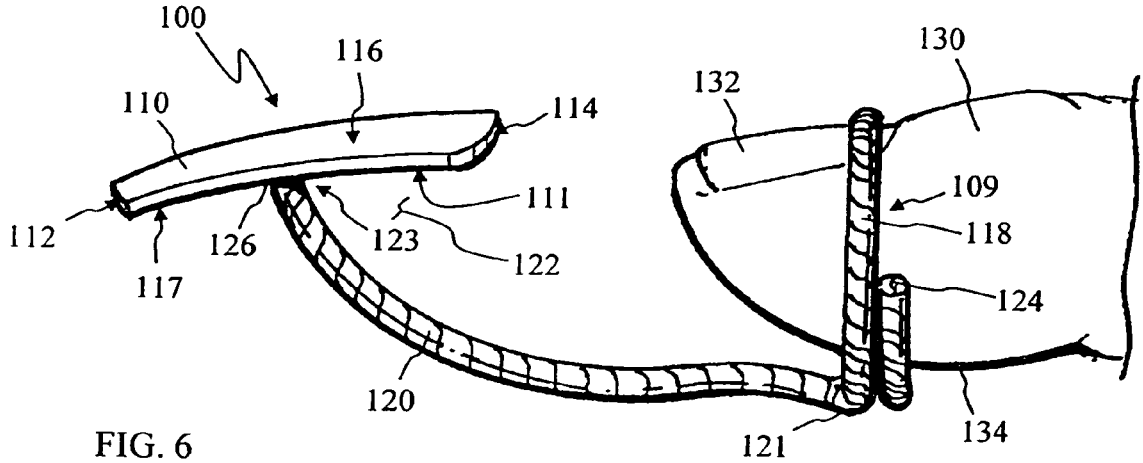
FIGS. 5 and 6 are simplified side views of the artificial nail apparatus of FIGS. 1–3 engaging a finger in accordance with the present invention.
Figure 6:
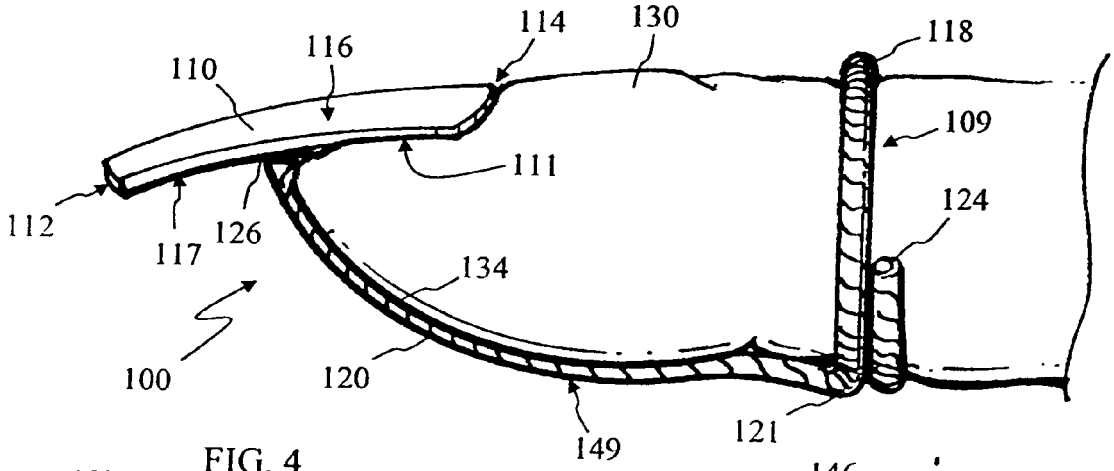

FIG. 5 and 6 are simplified side views and FIG. 7 is a simplified top view showing artificial nail apparatus 100 engaging the person's index finger 130, in accordance with the present invention. Finger 130 includes a finger nail 132 on one side and a finger pad 134 on its opposed side. As shown in FIG. 5, finger 130 is inserted into opening 109 of ring 118 and, as shown in FIG. 6, finger 130 is slid towards distal end 126 until finger nail 132 (FIG. 5) engages surface 111 of nail 110 near proximal end 114. To remove apparatus 100, the procedure is just reversed and finger 130 is slid from distal end 126 towards ring 118 where it is removed from opening 109.

As clearly shown in FIG. 6, bridge 120 is shaped to conform to the shape of finger pad 134 so that artificial nail apparatus 100 can be worn comfortably and snuggly. Since in this embodiment bridge 120 can be easily shaped, it can be bent to conform to the shape and size of a particular person's finger. This is useful if apparatus 100 is worn by different people who generally have different size fingers or if it is worn by the same person on a different finger. In some embodiments, portions of bridge 120 can be coated with an elastomer material 149 (FIG. 6) to facilitate the gripping of items. This is particularly useful when gripping the item between the person's fingers, such as index finger 130 and a thumb (not shown). Elastomer material 149 can include a rubber or rubber like material, or another material that increases the friction of bridge 120 to facilitate the gripping of an item.

As shown in FIG. 7, when finger 130 is inserted into artificial nail apparatus 100, ring 118 appears like an ordinary ring from the top view. This is because bridge 120 is positioned adjacent to finger pad 134 (FIG. 6) so it is not seen from the top view. Further, nail 110 fits over finger nail 132 (FIG. 5) so that nail 110 looks like a finger nail. It should be noted that nail 132 and bridge 120 are shown in phantom in FIG. 7. In some embodiments, as discussed above in conjunction with FIG. 4, apparatus 100 can include jewel holder 144 and jewel 146 to add these esthetic features to ring 118.

These esthetic features can be easily added because the various components of artificial nail apparatus 100 can be easily and conveniently interchanged. Hence, the person can have different styles of finger-engaging elements 118 and 104 and different styles of nails 108 and 110 which can be worn in different combinations. For example, nail 108 can be worn with finger-engaging element 118 and nail 110 can be worn with finger-engaging element 104. It should be appreciated that the person can have several nails like nail 108 or 110 with different colors, shapes, and ornamental and decorative features and, as discussed above, they can be interchangeably coupled to elements 118 and 104 through bridge 120.

Similarly, the person can have several finger-engaging elements like elements 104 and 118, with or without jewelry that can be interchangeably coupled to different styles of nails. In this way, the person has the added convenience of being able to choose the look of artificial nail apparatus 100 and 107 depending on several factors, such as the occasion, mood, dress, etc. The different nails and finger-engaging elements can be provided in a package of nail accessories and/or they can be sold separately or in various combinations. The various nail and finger-engaging elements can be fastened together in many different ways to facilitate their interchangeability, as will be discussed presently.

Figure 8:
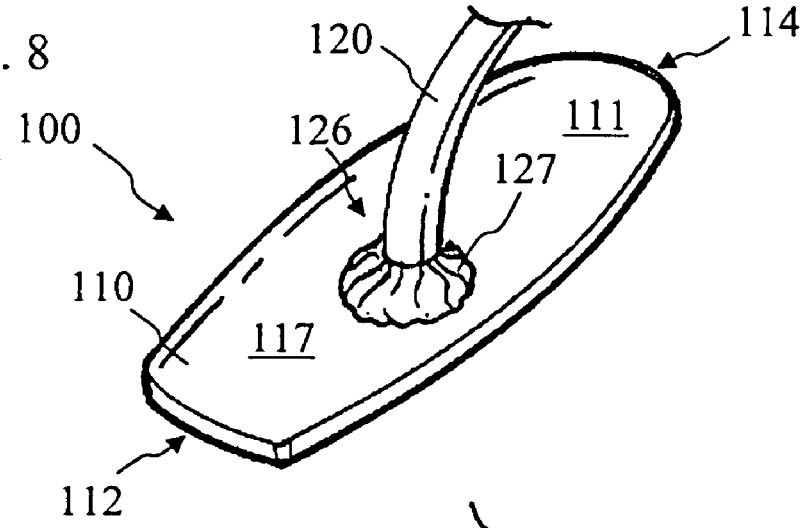
FIG. 8 is a simplified bottom view of the artificial nail of FIGS. 1–3 with a bonding region coupling a bridge to the artificial nail.

FIG. 8 is a simplified bottom view of the engagement between nail 110 and bridge 120 using a bonding region 127. It should be noted that the discussion here, as well as in FIG. 9 below, applies equally well to nail 108 and bridge 120 discussed above in FIG. 4. In this embodiment, bonding region 127 is applied to end 126 of bridge 120 and end 126 is attached at engagement location 123 (not shown) between distal end 112 and proximal end 114. Bonding region 127 can include a welding or soldering joint, glue, or another adhesive known in the art which fastens end 126 to engagement location 123. Here, however, bonding region 127 can be undone in many different ways so that end 126 can be detached from surface 117 to facilitate the interchangeability of the components. For example, bonding region 127 can be undone by heating it, if it includes a weld or solder joint, or dissolving it in a solvent, if it includes glue or another adhesive. Nail 110 can then be replaced with another nail or finger-engaging element 101 can be replaced with another finger-engaging element and bonding region 127 can be reapplied. In this way, the person can choose the esthetic appearance of apparatus 100 and 107.

Figure 9:
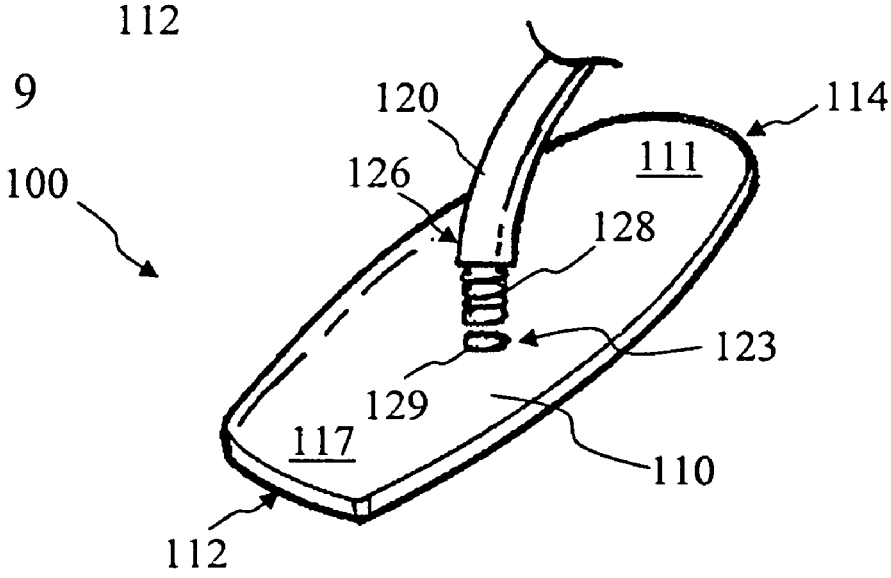
FIG. 9 is a simplified bottom view of the artificial nail of FIGS. 1–3 with complementary male and female components coupling the bridge to the artificial nail.

FIG. 9 is a simplified bottom view of artificial nail apparatus 100 showing the engagement between nail 110 and bridge 120 using complementary male and female components. In this embodiment, the male component includes a threaded portion 128 positioned at distal end 126 of bridge 120. Further, the female component includes a threaded opening 129 positioned on nail 110. Threaded opening 129 extends through nail 110 and is positioned at engagement location 123 between distal and proximal ends 112 and 114. Nail 110 and bridge 120 can be fastened together by threadingly engaging threaded portion 128 and threaded opening 129. It should be noted that in other embodiments, bridge 120 can carry threaded opening 129 and nail 110 can carry threaded portion 128 so that the positioning of the male and female components can be reversed. In either embodiment, the person can easily remove nail 110 from end 126 and replace it with another nail that the person desires to wear by simply disengaging threaded portion 128 from opening 129. It should also be noted that there are other ways of fastening bridge 120 to nail 110 using other male and female components. For example, the male and female components can include a pocket which receives the person's natural nail, a tongue and groove structure, male and female snaps, or a tongue and pocket structure, so that they can be easily unfastened, but only a few ways are shown here and in FIG. 8 for illustrative purposes.

Figure 10:
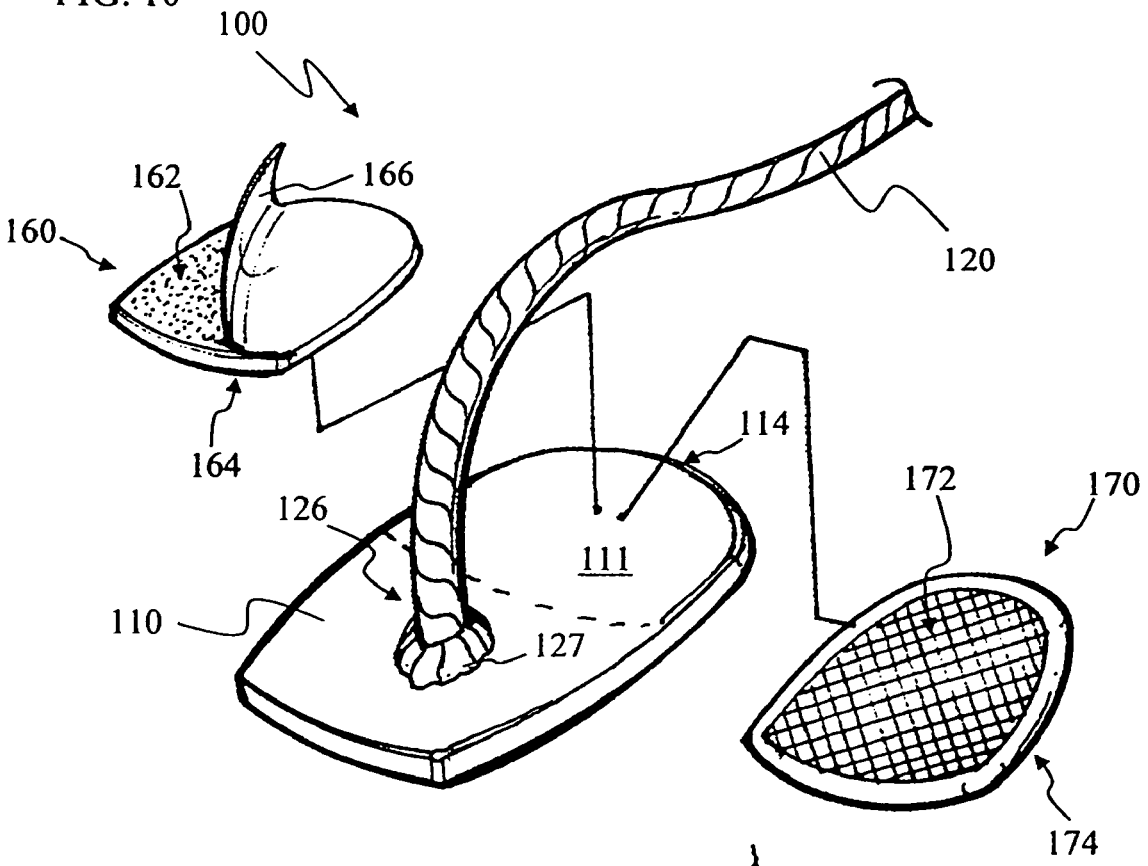
FIG. 10 is a simplified bottom view of the artificial nail apparatus of FIGS. 1–3 with an adhesive or bandage strip, in accordance with the present invention.

FIG. 10 is a simplified perspective view of a portion of artificial nail apparatus 100 with an adhesive strip 160 for more firmly holding nail 110 to the persons natural finger nail, such as finger nail 132 in FIG. 5. In one embodiment, adhesive strip 160 is positioned on surface 111 so that surface 111 near proximal end 114 is more strongly attached to the persons natural finger nail when it engages apparatus 100, as shown in FIG. 6. Here, adhesive strip 160 includes an adhesive surface 162 and an opposed adhesive surface 164 so that it operates as a double-sided adhesive strip. Accordingly, one of surface 162 or 164 can be positioned on surface 111 and the other one can be positioned on the person's finger nail so that nail 110 is more firmly held to the person's finger. In this example, adhesive surface 162 is covered with a pealable backing 166 to keep it clean and/or to prevent its adhesion properties from deteriorating when adhesive strip 160 is not being used or is in storage. It should be noted that in some embodiments, adhesive surface 162 can also include a pealable backing similar to pealable backing 166.

In another embodiment, a bandage 170 is carried on surface 111 near proximal end 114. In this example, bandage 170 includes a bandage surface 172 on one side and an opposed surface 174 on its other side. Surface 111 near proximal end 114 carries bandage 170 so that surface 174 is adjacent to it and bandage surface 172 is held on the person's finger nail when the person's finger engages apparatus 100, as shown in FIG. 6. Hence, if the person's finger nail is damaged or missing, then bandage surface 172 can be used to cover it and promote healing. It should be noted that surface 174 can be an adhesive surface similar to surfaces 162 and 164 so that bandage 170 is held in place. Further, in some examples, adhesive strip 160 can be positioned on surface 111 as described above, then surface 174 of bandage 170 can be attached to strip 160 so that bandage 170 is held in place.

In some embodiments, bandage surface 172 is covered with a medicine which is desired to apply to the person's finger nail or a nearby region. The medicine can include many different medicines known in the art, such as medicines to reduce swelling, promote healing, reduce infections, heal nail fungus, etc. The bandages and various adhesives described here can be packaged with artificial nail apparatus 100 or 107 or they can be sold separately as an accessory. Further, the bandage can be packaged with the medicine pre-applied or it can be applied by the person.

Artificial nail apparatus 100 also provides protection to the person's fingernail. For example, if the person's finger nail is damaged or missing, then bandage surface 172 can be used to cover it while the finger nail heals and/or regrows. In this way, it will still look like the person has a finger nail present because nail 110 can be made to appear like the missing nail or an artificial nail which covers the damage. Hence, artificial nail apparatus 100 can be used as a fingernail shield or guard to protect the person's finger nail from accidentally being touched or hit, which can cause pain or prolong the healing process. Artificial nail apparatus 100 provides this protection with better esthetic properties than an unsightly bandage, which may draw unwanted attention. It should be appreciated that apparatus 100 can be used in many other different ways. For example, it can be worn as a jewelry piece.

Figure 11:
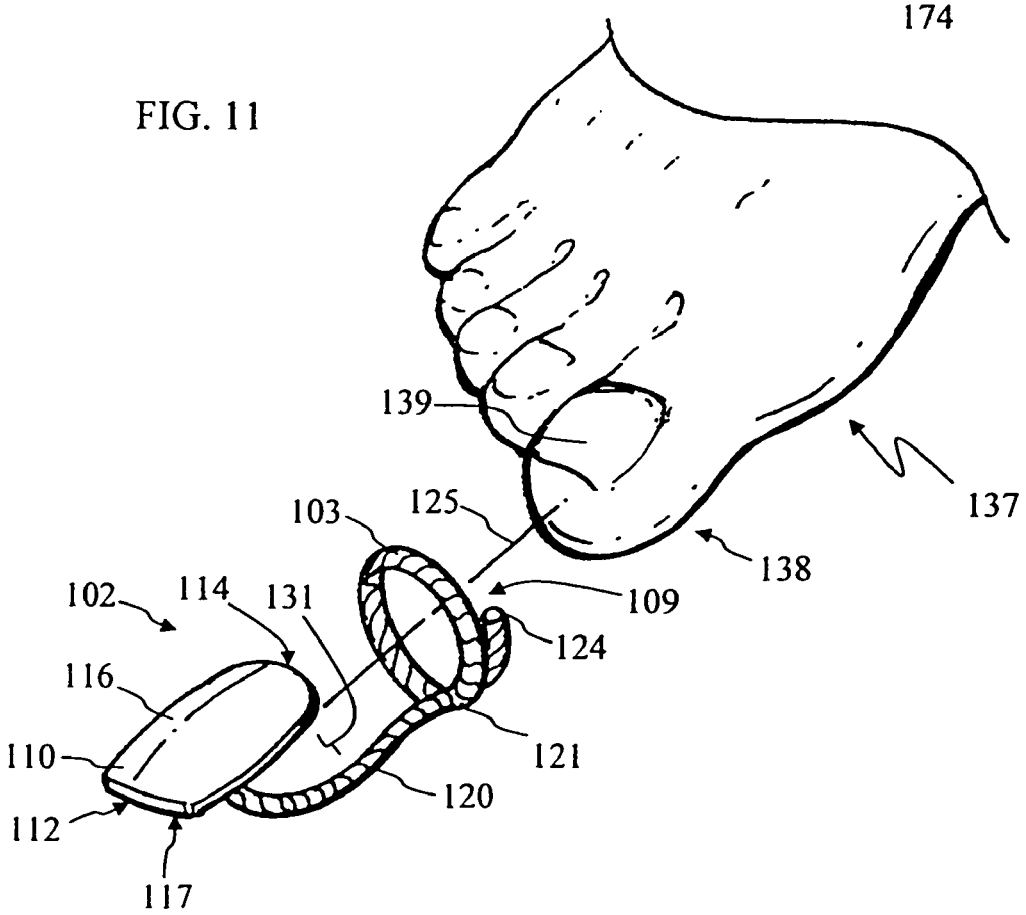
FIG. 11 is a simplified perspective view of an artificial nail apparatus, in accordance with the present invention, designed to be worn on a toe.

FIG. 11 is a simplified perspective view of a artificial nail apparatus 102 in accordance with the present invention. In this embodiment, apparatus 102 is similar in structure to apparatus 101, but is sized to allow the person to wear it on his or her foot 137. In particular, apparatus 102 includes bridge 120 coupled to a toe-engaging element 103. In this embodiment, however, digit receiving opening 109 of toe-engaging element 103 is sized and shaped so that toe 138 can be inserted therethrough. Further, bridge 120 and proximal end 114 of nail 110 are spaced apart to form a toe receiving space 131 which is sized and shaped to receive toe 138. Accordingly, nail 110 is sized and shaped to look like a toe nail 139 instead of a finger nail as described above. In this example, toe nail 139 is shown as being the big toe for illustrative purposes, but it could be one of the other toes and artificial nail apparatus 102 can be sized and shaped accordingly.

The present invention is described above with reference to a preferred embodiment. However, those skilled in the art will recognize that changes and modifications may be made in the described embodiment without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same,

The invention claimed is:

1. An artificial nail apparatus, comprising:

an artificial nail including an upper surface, an opposing lower surface, and an end; and a bridge having a first end fastened to the artificial nail at an engagement location and an opposing second end;

a digit engaging element carried by the second end;

a nail facing surface of the lower surface of the artificial nail between the engagement location and the end;

a digit receiving space between the nail facing surface and the bridge; and a nail engaging bandage carried by the nail facing surface.

2. The apparatus of claim 1, wherein the digit engaging element comprises a ring with a digit receiving opening therethrough.

3. The apparatus of claim 1, wherein the digit engaging element comprises a helical ring with a digit receiving opening therethrough.

4. The apparatus of claim 1, wherein the digit engaging element and bridge are formed from an elongate strand.

5. The apparatus of claim 1, further including a fastener which fastens the first end of the bridge to the artificial nail.

6. The apparatus of claim 1, further including a nail engaging adhesive carried by the nail facing surface.

7. An artificial nail apparatus, comprising:

an artificial nail including an upper surface, an opposing lower surface, a distal end, and a proximal end;

a bridge having a first end, and an opposing second end fastened to the artificial nail at an engagement location on the lower surface of the artificial nail between the proximal and distal ends;

a digit engaging element carried by the second end, the digit engaging element having a digit receiving opening;

a nail engaging surface of the lower surface of the artificial nail between the engagement location formed on the lower surface of the artificial nail between the second end of the bridge and the lower surface of the artificial nail, and the proximal end of the artificial nail; and a digit receiving space between the nail engaging surface and the bridge extending between the proximal end of the artificial nail and the engagment location formed on the lower surface of the artificial nail between the second end of the bridge and the lower surface of the artificial nail, the digit receiving opening being coaxial with the digit receiving space.

8. The apparatus of claim 7, wherein the bridge is made of a bendable material.

9. The apparatus of claim 7, further including a fastener which couples the bridge to the artificial nail at the engagement location.

10. The apparatus of claim 7, further comprising a double sided adhesive strip positioned on the nail engaging surface.

11. The apparatus of claim 7, further comprising a bandage positioned on the nail engaging surface.

12. The apparatus of claim 7, wherein the bridge and digit engaging element are formed from an elongate strand.

13. The apparatus of claim 12, further comprising a bend in the elongate strand between the bridge and digit engaging element.

14. An artificial nail apparatus, comprising:

an artificial nail with an upper viewing surface and a lower non-viewing surface, the upper viewing surface being opposed to the non-viewing surface;

a bridge coupled to the non-viewing surface of the artificial nail at an intermediate location between proximal and distal ends of the nail;

a digit engaging element having a digit receiving opening, the digit engaging element being spaced apart from the proximal end of the nail by the bridge;

a fastener coupling the bridge to the non-viewing surface of the artificial nail;

a nail engaging surface of the lower surface of the artificial nail between the intermediate location and the proximal end of the artificial nail;

and a digit receiving space between the nail engaging surface and the bridge, the digit receiving opening being coaxial with the digit receiving space.

15. The apparatus of claim 14, wherein the bridge is made of a bendable material.

16. The apparatus of claim 14, wherein the digit engaging element appears as a ring when engaging a digit and viewed from the upper viewing surface of the artificial nail.

17. The apparatus of claim 14, further comprising an adhesive carried by the nail engaging surface of the artificial nail.

18. The apparatus of claim 14, further comprising a bandage carried by the nail engaging surface of the artificial nail.

19. The apparatus of claim 14, further including male and female components which fasten the bridge and artificial nail together.

* * * * *